US009381567B2

(12) United States Patent
Genualdi et al.

(10) Patent No.: US 9,381,567 B2
(45) Date of Patent: Jul. 5, 2016

(54) METHODS TO CONTROL MACRO SHRINKAGE POROSITY AND GAS BUBBLES IN CAST ALUMINUM ENGINE BLOCKS

(71) Applicant: GM Global Technology Operations LLC, Detroit, MI (US)

(72) Inventors: Andrew J. Genualdi, Archbold, OH (US); Peggy E. Jones, Saginaw, MI (US); Qigui Wang, Rochester Hills, MI (US); Christopher C. Stanfield, Defiance, OH (US)

(73) Assignee: GM Global Technology Operations, LLC, Detroit, MI (US)

( * ) Notice: Subject to any disclaimer, the term of this patent is extended or adjusted under 35 U.S.C. 154(b) by 410 days.

(21) Appl. No.: 14/088,579

(22) Filed: Nov. 25, 2013

(65) Prior Publication Data

US 2015/0148936 A1 May 28, 2015

(51) Int. Cl.
*B22D 21/00* (2006.01)
*B22D 46/00* (2006.01)

(52) U.S. Cl.
CPC ..... *B22D 21/007* (2013.01)

(58) Field of Classification Search
CPC ..... B22D 21/007
See application file for complete search history.

(56) References Cited

U.S. PATENT DOCUMENTS 7,666,353 B2 * 2/2010 Donahue ..... C22C 21/04 420/548
8,758,529 B2 * 6/2014 Wang ..... C22C 21/02 148/417

OTHER PUBLICATIONS

Bonsignore et al., "Calcium Metal as a Scavenger for Antimony from Aluminum Alloys", Argonne National Laboratory, Technical Report; Oct. 4, 1994, pp. 1-12.
Farahany et al., "Effect of bismuth on microstructure of unmodified and Sr-modified A1-7Si-0.4Mg alloys", Transactions of Nonferrous Metals Society of China; vol. 21 (2011), pp. 1455-1464.
Farahany et al., "Evaluation of the effect of Bi, Sb, Sr and cooling condition on eutectic phases in an A1-Si-Cu alloy (ADC12) by in situ thermal analysis", Thermochimica Acta 559 (2013) pp. 59-68.
Garat et al., "A Review of Recent French Casting Alloy Developments", AFS Transactions, vol. 86 (1978), pp. 549-562.
Loper et al., "Influence of Trace Amounts of Phosphorus in A1 Casting Alloys—A Review of the Literature", AFS Transactions, vol. 108 (2000), pp. 667-672.
Rathod et al., "Effect of Modifier and Grain Refiner on Cast AL-7SI Aluminum Alloy: A Review", International Journal of Emerging Trends in Engineering and Development, Issue 2, vol. 5 (Jul. 2012), pp. 574-582.
Wang et al., "Solidification of Eutectic in Hypoteutectic Al-Si Alloys", AFS Transactions, vol. 107 (1999), pp. 249-256.
Campbell, John, "Castings Practice: The 10 Rules of Castings", Butterworth-Heinemann, U.S., 2004; pp. 9-107 (Book).

* cited by examiner

*Primary Examiner* — Kenneth M Lo
*Assistant Examiner* — David Wynne

(57) ABSTRACT

A method for estimating proper eutectic modification level in a liquid metal to minimize macro shrinkage porosity and gas bubbles during casting of aluminum automobile components, and a system and article for casting.

20 Claims, 3 Drawing Sheets

METHODS TO CONTROL MACRO SHRINKAGE POROSITY AND GAS BUBBLES IN CAST ALUMINUM ENGINE BLOCKS

FIELD OF THE INVENTION

The present invention is related generally to methods to ensure high quality aluminum casting, and in particular to a methodology to reduce and eliminate macro shrinkage porosity and gas bubbles by controlling trace element contents in liquid metal.

BACKGROUND OF THE INVENTION

Porosity has long been recognized as an important detrimental factor affecting mechanical properties and performance of cast components. Shrinkage and gas precipitation are two main sources for porosity formation in aluminum castings. For a given casting process and a design of casting geometry and gating/riser system, alloy composition, in particular trace elements such as strontium (Sr), phosphorus (P), bismuth (Bi), calcium (Ca), and others, can play an important role in solidification characteristics and thus porosity formation.

It is well known that modification of the acicular silicon present in cast Al—Si alloys to a fine fibrous form results in an improved strength and ductility for these alloys. The technology of modification has matured since Pasz first introduced sodium (Na) to modify eutectic silicon in 1920. Additions made for modification and refinement of silicon structure now include strontium (Sr) and antimony (Sb). Several reports have appeared in the literature of negative interactions between antimony and either strontium or sodium. It was reported that Sb concentrations as low as 100 ppm can significantly affect the tensile elongation of Sr modified A356 alloy. This deterioration in mechanical properties was exacerbated by the presence of phosphorus (P). P. V. Bonsignore, E. J. Daniels and C. T. Wu, Calcium Metal as a Scavenger for Antimony from Aluminum Alloys, Argonne National Laboratory, Technical Report, Oct. 4, 1994. To achieve the similar eutectic silicon morphology in the presence of varying levels of P, sufficient Sr needs to be added. FIG. 1 quantitatively shows that higher Sr concentrations are required for retaining good modification when P neutralization of the Sr effects is considered. M. Garat and R. Scalliet, A review of recent French casting alloy development, AFS Transactions, vol. 86 (1978), pp 549-562.

Phosphorus is an impurity associated with silicon used in the alloy. The effect of P, at or beyond concentrations of a few of ppm, is not only to perform the function of nucleating primary Si in eutectic or hyper-eutectic but also to yield a distinctly acicular eutectic silicon structure in Al—Si hypoeutectic alloys. It was also found that both the number of primary cc-dendrites and the dendrite arm spacing (DAS) was increased in the high-purity Al-10% Si alloy by the addition of 0.005% (50 ppm) of phosphorus. C. R. Loper and J.-I. Cho, Influence of trace amounts of phosphorus in Al casting alloys—A review of the literature, vol. 108 (2000), pp. 667-672.

Magnesium also tends to coarsen the eutectic silicon structure and thus reinforces the effect of P. For example, an Al-7% Si alloy containing 2 ppm P still exhibits a lamellar silicon structure, whereas Al-7% Si-0.3% Mg alloy also containing 2 ppm P is acicular. M. Garat and R. Scalliet, A review of recent French casting alloy development, AFS Transactions, vol. 86 (1978), pp 549-562.

Like phosphorus, bismuth also neutralizes the effect of Sr modification. To retain full modification, Sr/Bi mass ratio higher than 0.45 is required when bismuth is present in the melt. S. Farahany, A. Ourdjini, M. H. Idris, L. T. Thai, Effect of bismuth on microstructure of unmodified and Sr-modified Al-7Si-0.4 Mg alloys, Trans. Nonferrous Met. Soc. China vol. 21 (2011), pp 1455-1464. S. Farahany, A. Ourdjini, M. H. Idrsi, S. G. Shabestari, Evaluation of the effect of Bi, Sb, Sr and cooling condition on eutectic phases in an Al—Si—Cu alloy (ADC12) by in situ thermal analysis, Thermochimica Acta, 559 (2013) 59-68. N. R. Rathod, J. V. Manghani, Effect of Modifier and Grain Refiner on Cast Al-7si Aluminum Alloy: A Review, International Journal of Emerging Trends in Engineering and Development, Issue 2, Vol. 5. (JULY-2012), pp. 574-582.

In spite of the positive effect of Sr modification on tensile strength and particularly ductility, excessive modification increases the tendency of microporosity due to the change of solidification characteristics and formation of dual primary and eutectic grain structures Q. G. Wang, D. Apelian, L. Arnberg, S. Gulbrandsen-Dahl, and J. Hjelen, Solidification of the Eutectic in Hypoeutectic Al—Si Alloys, AFS Transactions, vol. 107 (1999), pp. 249-256. It has also been reported that the excessive eutectic modification delays the formation of an impermeable casting skin and thus increases core gas penetration from the sand cores, resulting in gas bubbles in the solidified castings. (These exogenous gas bubbles are distinct from gas porosity resulting from the rejection of hydrogen dissolved in the liquid aluminum during solidification.)

Therefore, it is important in aluminum casting to properly control eutectic modification levels to minimize macro shrinkage porosity and gas bubbles simultaneously. The disclosed methods, systems, and articles of manufacture in this invention are intended to solve this problem.

SUMMARY OF THE INVENTION

The present invention is related generally to methods to ensure high quality aluminum casting, in particular, methodology, systems, and articles of manufacture to reduce and eliminate macro shrinkage porosity and gas bubbles by controlling trace element contents in liquid metal. The disclosed invention is suitable for sand casting, semi-permanent mold casting, lost foam casting, and investment casting of aluminum-based automobile components. The disclosed invention is even more particularly suitable for chemical-bonded sand casting, also called precision sand casting. Investment casting is the modern industrial term for lost-wax casting. High pressure die casting, with its inherent formation of internal gas bubbles and shrinkage, is not a preferable casting method for the present invention. The disclosed invention is suitable for the fabrication of engine blocks, water pumps and cases, valve bodies, transmission cases, gear carries, and oil pumps by precision sand casting, and also for the fabrication of cylinder heads and bed plates by semi-permanent mold casting.

One aspect of the invention relates to a method of fabricating aluminum automobile components through sand casting, permanent mold casting, lost foam casting and investment casting, by estimating proper eutectic modification level in a liquid metal to minimize macro shrinkage porosity and gas bubbles during aluminum casting. The method of estimating proper eutectic modification level includes using (Eqn. 2) to first estimate the effective P level in the liquid metal. Both Sb and Bi have a similar effect as P, with all three elements countering the modification effect of Sr. As such, P, Sb, and Bi need to controlled by determining the weight percent of P, Sb, and Bi in the liquid metal. As Ca serves as an effective scavenger of Sb and Bi and is effective for removing Sb from molten aluminum alloys, the weight percent of Ca in the liquid metal is also determined. Based on the estimation of the effective P level in the liquid, the method of estimating proper eutectic modification level includes using (Eqn. 3) to estimate the required minimal addition of Sr to the liquid metal to eliminate macro shrinkage. The method further includes using (Eqn. 4) to estimate the allowed maximal addition of Sr to the liquid metal eliminate gas bubbles. The various constants of (Eqns. 2-4) depend on a given set of casting component geometry and casting process parameters. Once the proper eutectic modification level is estimated, the liquid metal is modified to the proper eutectic level and introduced into a casting mold such that porosity due to at least one of macro shrinkage and gas bubble formation is reduced. The liquid metal is subsequently cooled until it is substantially solidified.

Another aspect of the invention relates to a system to estimate the proper eutectic modification level of a liquid metal during various casting techniques used to make aluminum-based automobile components. The system includes an information input configured to receive information relating to at least one of trace elements of the liquid metal, casting component geometry, and casting process parameters; an information output configured to convey information relating to proper eutectic modification level predicted by the system; a processing unit; and a computer-readable medium comprising a computer readable program code embodied therein, said computer-readable medium cooperative with the computer processor, the information input and the information output such that the received information is operated upon by the computer processor and the computer-readable program code to be presented to the information output as proper eutectic modification level, said computer-readable program code comprising a proper eutectic modification level module, wherein: the proper eutectic modification level module estimates the required minimal addition of strontium to the liquid metal using the equations described above.

Another aspect of the invention relates to an article of manufacture to estimate the proper eutectic modification level of a liquid metal during various casting techniques used to make aluminum-based automobile components, the article of manufacture comprising an information input, an information output, a computer processor, and at least one computer usable medium, wherein: the information input is configured to receive information relating to at least one of trace elements of the liquid metal, casting component geometry, and casting process parameters; the information output is configured to convey information relating to proper eutectic modification level predicted by the article of manufacture; the processing unit is cooperative with the computer usable medium to operate upon computer-readable program code means embodied on the computer useable medium for estimating the required minimal addition of strontium to the liquid metal; and the computer useable medium comprises computer-readable program code means embodied therein for estimating the required minimal addition of strontium to the liquid metal using the equations described above; the computer useable medium is cooperative with the information input and the information output such that the received information is operated upon by the computer-readable program code means to be presented to the information output as an estimation of the proper eutectic modification level of the liquid metal during aluminum casting.

DETAILED DESCRIPTION OF THE INVENTION

Figure 1:
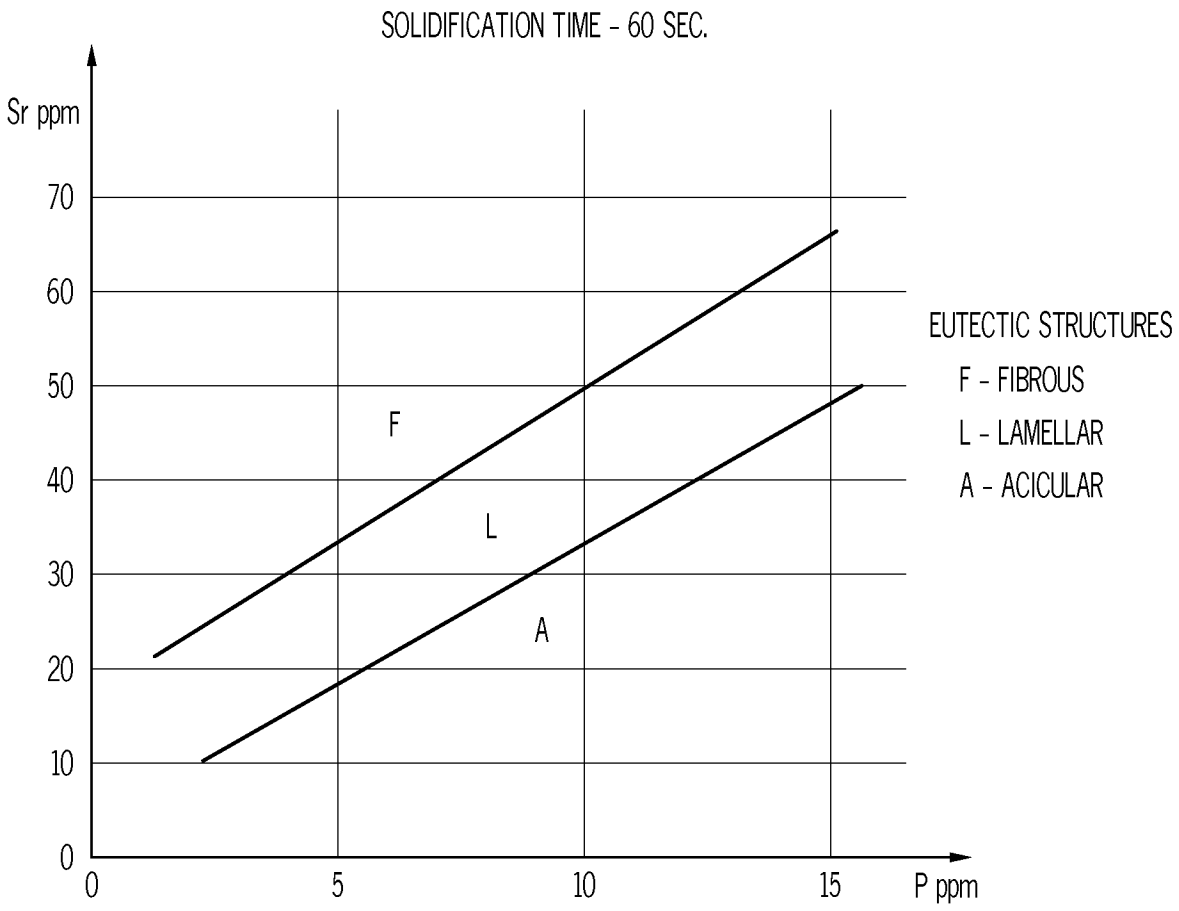
FIG. 1 (PRIOR ART)
FIG. 1 is a graph illustrating Sr and P interaction in Al-7% Si alloy.

For a given casting process and a design of casting geometry and gating/riser system, alloy composition, in particular trace elements, can play an important role in casting quality and scrap rate. It was found that macro-shrinkage porosity and gas bubbles in sand cast aluminum engine blocks are strongly related to trace element (Sr, P, Bi, Ca, etc) contents and their combinations in the aluminum alloys. The increased level of eutectic silicon modifier neutralizer such as P, Bi, Sb etc. in liquid metal requires larger additions of eutectic silicon modifiers such as Sr, Ca, and Na to achieve the similar shrinkage results. The excessive addition of eutectic modifier, however, can result in formation of extensive gas bubbles. The following relationship between effective eutectic modifier addition and effective modifier neutralizer level in the liquid melt has been determined to be very useful in quality control of aluminum castings, particularly for hypoeutectic and near eutectic aluminum alloys that contain silicon, such as 319, 356, 380, 354, and 355, in sand castings, permanent mold castings, lost foam castings and investment castings.

$$Sr_{eff}(\text{wt }\%)=a+b*P_{eff}(\text{wt }\%) \quad (1)$$

where a and b are constants that depend on a given set of casting component geometry and casting process parameters. $Sr_{eff}$ is effective strontium addition in weight percent. $P_{eff}$ is effective phosphorus weight percent.

Like phosphorus, antimony (Sb) and bismuth (Bi) counter the modification effect of strontium and sodium, and thus they should be avoided or controlled as well. Calcium (Ca) is an effective scavenger of Sb and Bi. It was found that Ca is, indeed, effective for removing Sb from molten aluminum alloys although its effectiveness can be compromised by a wide range of processing conditions. A minimum ratio of about four to one, by weight, of Ca to Sb appears necessary to insure an effective scavenging of contained Sb in 356 aluminum alloys.

Considering that it is difficult and costly to eliminate trace elements in practice, the combined effect of trace elements on eutectic modification should be accounted for to determine the required amount of Sr or combined effective eutectic modifiers. It was found that the effective phosphorus can be estimated using:

$$P_{eff}(\text{wt }\%)=P+c1*Sb(\text{wt }\%)+c2*Bi(\text{wt }\%)-c3*Ca(\text{wt }\%) \quad (2)$$

where c1, c2, c3 are constants that depend on a given set of casting component geometry and casting process parameters; $P_{eff}$ (wt %) is the combined effect in weight percent of trace elements on eutectic modification; Sb (wt %) is the antimony weight percent in the liquid metal; Bi (wt %) is the bismuth weight percent in the liquid metal; and Ca (wt %) is the calcium weight percent in the liquid metal;

Therefore, it was determined that the proper eutectic modification level in a liquid metal for the minimization of macro shrinkage porosity and gas bubbles during various casting techniques used to make aluminum-based automobile components can be estimated using three equations: one that estimates the effective phosphorus level in the liquid metal (Eqn. 2), another that estimates the required minimal addition of strontium to the liquid metal to eliminate macro shrinkage (Eqn. 3), and another that estimates the allowed maximal addition of strontium to the liquid metal to eliminate gas bubbles (Eqn. 4). As such, according to certain embodiments of the methods, systems, and articles of the present invention the proper eutectic modification level in a liquid metal can be estimated by:

$$P_{eff}(\text{wt }\%)=P(\text{wt }\%)+c1*Sb(\text{wt }\%)+c2*Bi(\text{wt }\%)-c3*Ca(\text{wt }\%) \quad (2);$$

$$Sr_{eff\text{-}min}(\text{wt }\%)=a1+b1*P_{eff}(\text{wt }\%) \quad (3);$$

$$Sr_{eff\text{-}max}(\text{wt }\%)=a2+b2*P_{eff}(\text{wt }\%) \quad (4);$$

$P_{eff}$ (wt %) is the combined effect of trace elements P, Sb, Bi, and Ca in weight percent on eutectic modification. P, Sb, and Bi all counter the modification effect of Sr. Therefore, these trace elements need to controlled by determining their weight percent in the liquid metal. Additionally, Ca serves as a scavenger of Sb and Bi and is effective for removing Sb from molten aluminum alloy. As such the weight percent of Ca in the liquid metal is also determined. Based on the estimation of the effective P level in the liquid using (Eqn. 2), the required minimal addition of Sr in weight percent ($Sr_{eff\text{-}min}$ (wt %)) of the liquid metal is estimated to eliminate macro shrinkage using (Eqn. 3). Additionally, the allowed maximum addition of Sr in weight percent ($Sr_{eff\text{-}max}$ (wt %)) of the liquid metal is estimated to eliminate gas bubbles using (Eqn. 4). For (Eqns. 2-4), a1, a2, b1, b2, c1, c2, c3 are constants that depend on a given set of casting component geometry and casting process parameters. For cast aluminum silicon alloys, a1 varies from 0.002 to 0.005, a2 varies from 0.003 to 0.01, b1 and b2 vary from 3 to 3.5, and c1, c2, and c3 vary from 0 to 1.

As a general quality control guideline, the phosphorus content should be maintained at less than 0.0007% (7 ppm) and preferably less than 0.0005% (5 ppm) in hypoeutectic alloys and less than 0.0015% (15 ppm) and preferably less than 0.001% (10 ppm) in eutectic alloys.

As strontium and sodium produce equivalent eutectic modification, the effective strontium in the aluminum alloy in certain embodiments of the methods, systems, and articles of the present invention can be estimated using:

$$Sr_{eff}(\text{wt }\%)=Sr(\text{wt }\%)+d1*Na(\text{wt }\%) \quad (5)$$

where d1 is a constant varying from 0 to 1; Na (wt %) is the sodium weight percent in the liquid metal; and Sr (wt %) is $Sr_{eff\text{-}min}$ (wt %) from Eqn. 3 (the required minimal addition of strontium weight percent to the liquid metal eliminate macro shrinkage and/or $Sr_{eff\text{-}max}$ (wt %) from Eqn. 4 (the allowed maximal addition of strontium weight percent to the liquid metal eliminate gas bubbles).

Figure 3:
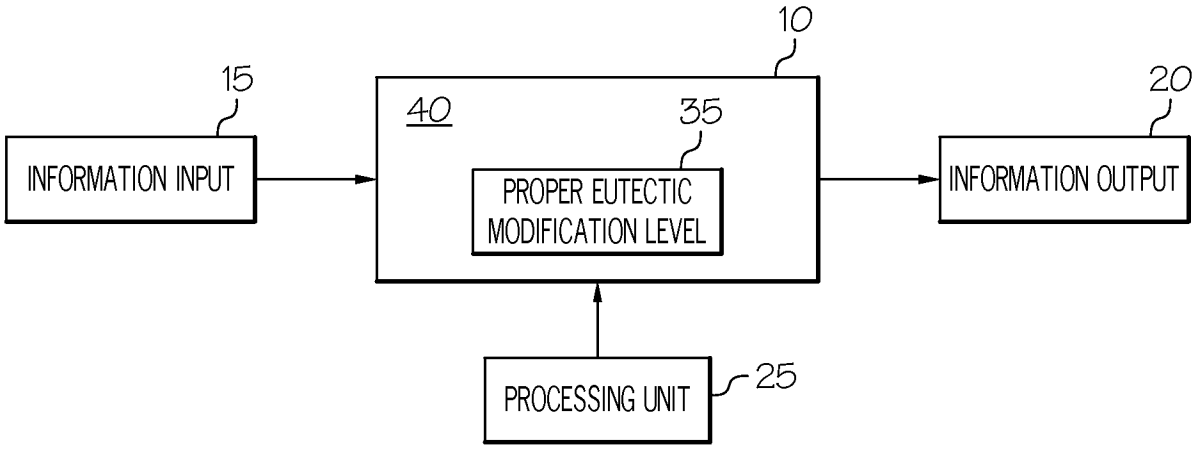
FIG. 3 illustrates a system to estimate the proper eutectic modification level of a liquid metal during casting according to certain embodiments of the present invention.

In certain embodiments, shown in FIG. 3, a system 10, for example, may estimate proper eutectic modification level of a liquid metal during various casting techniques used to make aluminum-based automobile components. The system 10 comprises an information input 15, and information output 20, a processing unit 25, and a computer-readable medium 30. The information input 15 is configured to receive information relating to at least one of trace elements of the liquid metal, casting component geometry, and casting process parameters, while the information output 20 is configured to convey information relating to proper eutectic modification level predicted by the system 10. The computer-readable medium 30 comprises a computer readable program code embodied therein, the computer-readable program code comprises a proper eutectic modification level module. The computer-readable medium is cooperative with the computer processor, the information input, and the information output such that the received information is operated upon by the computer processor and the computer-readable program code to be presented to the information output as proper eutectic modification level, said computer-readable program code comprising a proper eutectic modification level module, wherein the proper eutectic modification level module estimates the required minimal addition of strontium to the liquid metal using equations 2-4 above.

In other embodiments, the liquid metal is an aluminum silicon alloy.

In additional embodiments, the received information relating to trace elements of the liquid metal comprises at least one of phosphorus, antimony, bismuth, calcium, strontium, and sodium.

In further embodiments, the received information relating to casting component geometry comprises at least one of wall thickness and variations, geometrical structure configuration, maximum three dimensional dimensions, and shrinkage feeding capability, while in other embodiments the received information relating to casting process parameters comprises at least one of liquid metal pouring temperature, mold filling method and fill profile, chill and metal insert configuration and temperatures, casting mold temperature.

In certain embodiments, the received information relating to trace elements of the liquid metal is determined by at least one of direct measurement and analytical prediction. Further, in certain embodiments, direct measurement comprises weight percentage measurement of the trace element in the liquid metal by at least one of inductively coupled plasma atomic emission spectrometry (ICP-AES), inductively coupled plasma optical emission spectrometry (ICP-OES), inductively coupled plasma mass spectrometry (ICP-MS), atomic absorption spectrometry (AAS), and x-ray fluorescence spectrometry (XRF).

In other embodiments, the received information relating to casting component geometry and casting process parameters is determined by direct measurement.

EXAMPLES

The following examples are given by way of illustration and are in no way intended to limit the scope of the present invention.

Example 1

When phosphorus alone presents in the aluminum liquid metal, the required minimal effective Sr addition to achieve the desired modification level to reduce macro shrinkage porosity is:

$$Sr_{eff\text{-}min}(\text{wt }\%)=0.00206+3.36*P(\text{wt }\%) \quad (6)$$

Figure 2:
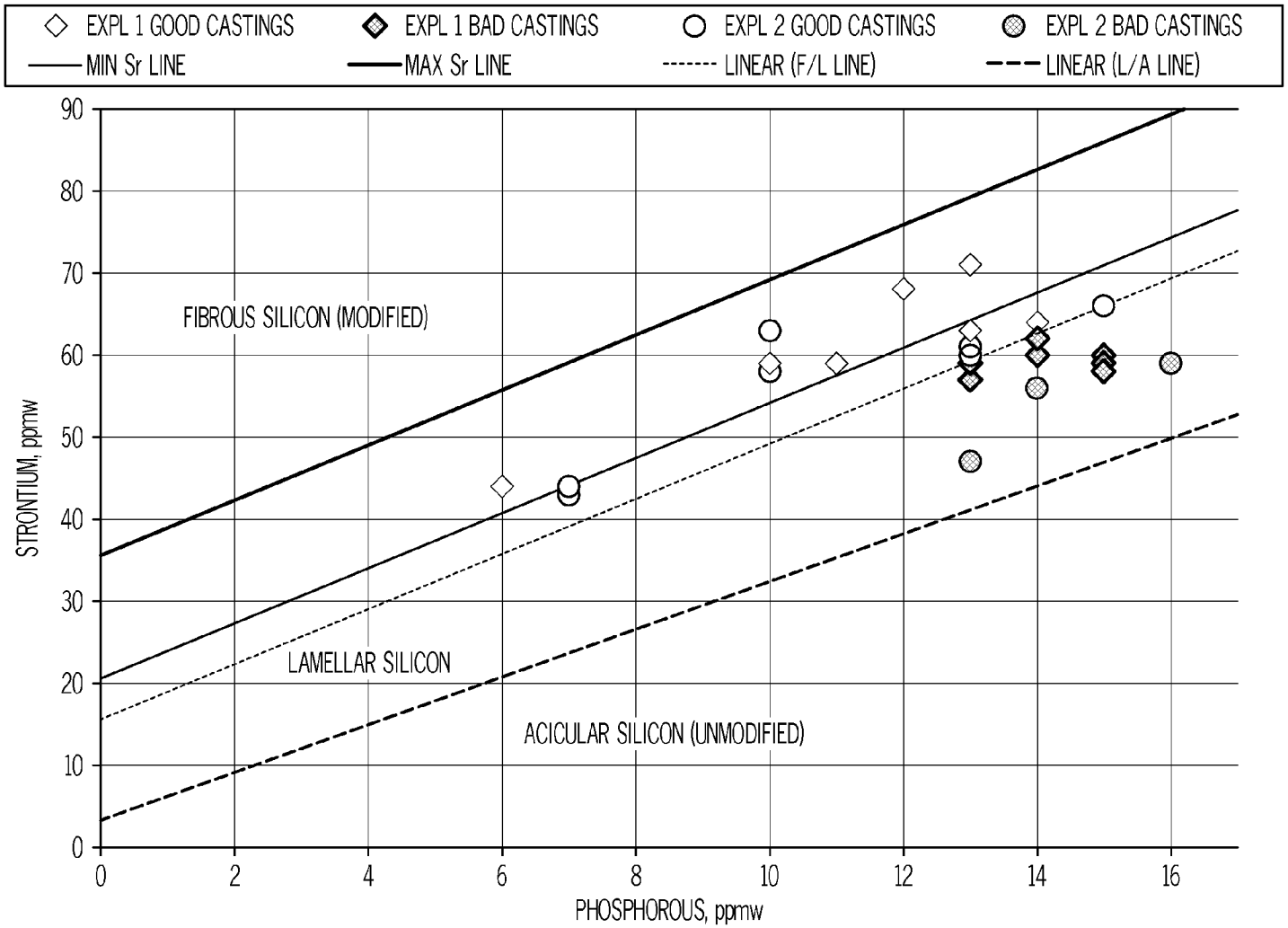
FIG. 2 is a graph illustrating Sr and P interaction in Al 319 alloy comparing experimental results to the minimum and maximum Sr specifications from Eqns. 6 and 7 (blue and red lines) and the boundaries between fibrous, lamellar, and acicular silicon from FIG. 1.

The allowed maximal effective Sr addition for not causing extensive gas bubbles is:

$$Sr_{eff\text{-}max}(\text{wt }\%)=0.00306+3.36*P(\text{wt }\%) \quad (7)$$

where:

P (wt %) is the phosphorous weight percent in the liquid metal;

FIG. 2 shows the relationships between Sr and P together with experimental results for aluminum 319 alloy. As expected, the controlled Sr level within the specification between the maximum and minimum contents has produced acceptable cylinder block castings.

Example 2

When phosphorus and antimony are both present in the aluminum liquid metal, the minimum required effective Sr addition to achieve the desired modification level to reduce macro shrinkage porosity is:

$$Sr_{eff\text{-}min}(wt\ \%)=0.002+3*P_{eff} \quad (8)$$

The maximum allowed effective Sr addition to prevent exogenous gas porosity is:

$$Sr_{eff\text{-}max}(wt\ \%)=0.003+3*P_{eff} \quad (9)$$

where $P_{eff}$ effective P is calculated by:

$$P_{eff}(wt\ \%)=P(wt\ \%)+0.12*Sb(wt\ \%) \quad (10)$$

Example 3

When phosphorus, antimony, bismuth, and calcium are present in the aluminum liquid metal, the minimum required effective Sr addition to achieve the desired modification level to reduce macro shrinkage porosity is:

$$Sr_{eff\text{-}min}(wt\ \%)=0.0025+3*P_{eff} \quad (11)$$

The maximum allowed effective Sr addition to prevent exogenous gas bubble defects is:

$$Sr_{eff\text{-}max}(wt\ \%)=0.0035+3*P_{eff} \quad (12)$$

where $P_{eff}$, effective P is calculated by:

$$P_{eff}(wt\ \%)=P+0.25*Sb+0.15*Bi-0.33*Ca \quad (13)$$

Example 4

For castings with thin and uniform sections, like high pressure die casting parts, an Al-11 to 13% Si based alloy modified with small amount of phosphorus (<0.0005 wt %, 5 ppmw) can offer excellent foundry properties, especially castability. With phosphorus refining the silicon, the alloy has no tendency to show shrinkage that extend to the casting surface (sinks) at hot spots, as was often the case with phosphorus-free alloy, whose structure was often lamellar. For thick or heavy sections, however, modification with phosphorus alone can cause sinks and cracks on the casting surfaces. It is thus proposed to modify the alloy with strontium or sodium, with preferable strontium, as shown in previous embodiments.

Example 5

In metal casing, entrained gas bubbles are caused by turbulent flow during mold filling. Campbell, John. *Castings Practice: The Ten Rules of Castings*. Butterworth-Heinemann, 2004, pp. 9-107. This is most commonly encountered in die casting operations where the trapped gas causes blisters when the parts are solution heat treated, but entrained gas defects can also be created when the liquid metal flow interacts with the casting geometry to create a "waterfall" or other turbulent fill condition in precision sand, lost foam, and conventional sand casting. The entrained gas may be able to vent through the porous skins in the casting by controlling the eutectic modification. To form the porous skins, the eutectic needs to be extensively modified. As a result, the effective Sr level should be much greater than the upper limits defined in previous embodiments. To vent the entrained gas bubbles, the desired effective Sr level is proposed as:

$$Sr_{eff}(wt\ \%)=0.01+3*P_{eff} \quad (14)$$

Where the effective phosphorus, $P_{eff}$, is determined according to the specific alloy compositions as described in previous embodiments.

As previously mentioned, the disclosed invention is suitable for sand casting, semi-permanent mold casting, lost foam casting, and investment casting of aluminum-based automobile components. The disclosed invention is even more particularly suitable for chemical-bonded sand casting, which is also called precision sand casting. Investment casting is the modern industrial term for lost-wax casting. High pressure die casting, with its inherent formation of internal gas bubbles and shrinkage, is not a preferable casting method for the present invention. The disclosed invention is suitable for the fabrication of engine blocks, water pumps and cases, valve bodies, transmission cases, gear carries, and oil pumps by precision sand casting, and also for the fabrication of cylinder heads and bed plates by semi-permanent mold casting.

It is noted that recitations herein of a component of an embodiment being "configured" in a particular way or to embody a particular property, or function in a particular manner, are structural recitations as opposed to recitations of intended use. More specifically, the references herein to the manner in which a component is "configured" denotes an existing physical condition of the component and, as such, is to be taken as a definite recitation of the structural factors of the component.

It is noted that terms like "generally," "commonly," and "typically," when utilized herein, are not utilized to limit the scope of the claimed embodiments or to imply that certain features are critical, essential, or even important to the structure or function of the claimed embodiments. Rather, these terms are merely intended to identify particular aspects of an embodiment or to emphasize alternative or additional features that may or may not be utilized in a particular embodiment.

For the purposes of describing and defining embodiments herein it is noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Having described embodiments of the present invention in detail, and by reference to specific embodiments thereof, it will be apparent that modifications and variations are possible without departing from the scope of the embodiments defined in the appended claims. More specifically, although some aspects of embodiments of the present invention are identified herein as preferred or particularly advantageous, it is contemplated that the embodiments of the present invention are not necessarily limited to these preferred aspects.

What is claimed:

1. A method of fabricating aluminum automobile components, by estimating proper eutectic modification level in a liquid metal to minimize macro shrinkage porosity and gas bubbles during aluminum casting, said estimating proper eutectic modification level comprising:

estimating the effective phosphorus level in the liquid metal using $$P_{eff}(\text{wt }\%)=P(\text{wt }\%)+c1*Sb(\text{wt }\%)+c2*Bi(\text{wt }\%)-c3*Ca(\text{wt }\%) \quad (2);$$

estimating the required minimal addition of strontium to the liquid metal using $$Sr_{eff\text{-}min}(\text{wt }\%)=a1+b1*P_{eff}(\text{wt }\%) \quad (3);$$

estimating the allowed maximal addition of strontium to the liquid metal using $$Sr_{eff\text{-}max}(\text{wt }\%)=a2+b2*P_{eff}(\text{wt }\%) \quad (4);$$

where:

$P_{eff}$ (wt %) is the combined effect of trace elements on eutectic modification;

P (wt %) is the phosphorous weight percent in the liquid metal;

Sb (wt %) is the antimony weight percent in the liquid metal;

Bi (wt %) is the bismuth weight percent in the liquid metal;

Ca (wt %) is the calcium weight percent in the liquid metal;

$Sr_{eff\text{-}min}$ (wt %) is the required minimal addition of strontium in weight percent to the liquid metal eliminate macro shrinkage;

$Sr_{eff\text{-}max}$ (wt %) is the allowed maximal addition of strontium in weight percent to the liquid metal eliminate gas bubbles;

and a1, a2, b1, b2, c1, c2, c3 are constants that depend on a given set of casting component geometry and casting process parameters;

providing a mold;

introducing the liquid metal into said mold such that porosity due to at least one of macro shrinkage and gas bubble formation is reduced; and cooling said liquid metal such that said liquid metal is substantially solidified.

2. The method of claim 1, wherein the casting is selected from the group consisting of sand casting, and investment casting and permanent mold casting.

3. A system to estimate proper eutectic modification level of a liquid metal during casting of aluminum automobile components, said system comprising:

an information input configured to receive information relating to at least one of trace elements of the liquid metal, casting component geometry, and casting process parameters;

an information output configured to convey information relating to proper eutectic modification level predicted by the system;

a computer processor; and a computer-readable medium comprising a computer readable program code embodied therein, said computer-readable medium cooperative with the computer processor, the information input and the information output such that the received information is operated upon by the computer processor and the computer-readable program code to be presented to the information output as proper eutectic modification level, said computer-readable program code comprising a proper eutectic modification level module, wherein:

the proper eutectic modification level module estimates the required minimal addition of strontium to the liquid metal using $$P_{eff}(\text{wt }\%)=P(\text{wt }\%)+c1*Sb(\text{wt }\%)+c2*Bi(\text{wt }\%)-c3*Ca(\text{wt }\%) \quad (2)$$

estimating the required minimal addition of strontium to the liquid metal using $$Sr_{eff\text{-}min}(\text{wt }\%)=a1+b1*P_{eff}(\text{wt }\%) \quad (3);$$

estimating the allowed maximal addition of strontium to the liquid metal using $$Sr_{eff\text{-}max}(\text{wt }\%)=a2+b2*P_{eff}(\text{wt }\%) \quad (4);$$

where:

$P_{eff}$ (wt %) is the combined effect of trace elements in weight percent on eutectic modification;

P (wt %) is the phosphorous weight percent in the liquid metal;

Sb (wt %) is the antimony weight percent in the liquid metal;

Bi (wt %) is the bismuth weight percent in the liquid metal;

Ca (wt %) is the calcium weight percent in the liquid metal;

$Sr_{eff\text{-}min}$ (wt %) is the required minimal addition of strontium in weight percent to the liquid metal eliminate macro shrinkage;

$Sr_{eff\text{-}max}$ (wt %) is the allowed maximal addition of strontium in weight percent to the liquid metal eliminate gas bubbles;

and a1, a2, b1, b2, c1, c2, c3 are constants that depend on a given set of casting component geometry and casting process parameters;

a mold configured to receive the liquid metal such that porosity due to at least one of macro shrinkage and gas bubble formation is reduced.

4. The system of claim 3, wherein the liquid metal is an aluminum silicon alloy.

5. The system of claim 4, wherein the aluminum silicon alloy comprises a hypoeutectic alloy or a near eutectic alloy.

6. The system of claim 3, wherein the received information relating to trace elements of the liquid metal comprises at least one of phosphorus, antimony, bismuth, calcium, strontium, and sodium.

7. The system of claim 3, wherein the received information relating to casting component geometry comprises at least one of wall thickness and variations, geometrical structure configuration, maximum three dimensional dimensions, and shrinkage feeding capability.

8. The system of claim 3, wherein the received information relating to casting process parameters comprises at least one of liquid metal pouring temperature, mold filling method and fill profile, chill and metal insert configuration and temperatures, casting mold temperature.

9. The system of claim 3, wherein the received information relating to trace elements of the liquid metal is determined by at least one of direct measurement and analytical prediction.

10. The system of claim 9, wherein said direct measurement comprises weight percentage measurement of the trace element in the liquid metal by at least one of inductively coupled plasma atomic emission spectrometry (ICP-AES), inductively coupled plasma optical emission spectrometry (ICP-OES), inductively coupled plasma mass spectrometry (ICP-MS), atomic absorption spectrometry (AAS), and x-ray fluorescence spectrometry (XRF).

11. The system of claim 3, wherein the received information relating to casting component geometry and casting process parameters is determined by direct measurement.

12. An article of manufacture to estimate proper eutectic modification level of a liquid metal during casting of aluminum automobile components, said article of manufacture comprising an information input, an information output, a processing unit, a mold, and at least one computer usable medium, wherein:

the information input is configured to receive information relating to at least one of trace elements of the liquid metal, casting component geometry, and casting process parameters;

the information output is configured to convey information relating to proper eutectic modification level predicted by the article of manufacture;

the processing unit is cooperative with the computer usable medium to operate upon computer-readable program code means embodied on the computer useable medium for estimating the required minimal addition of strontium to the liquid metal; and the computer useable medium comprises computer-readable program code means embodied therein for;

estimating the required minimal addition of strontium to the liquid metal using $$P_{eff}(\text{wt }\%)=P(\text{wt }\%)+c1*Sb(\text{wt }\%)+c2*Bi(\text{wt }\%)-c3*Ca(\text{wt }\%) \quad (2);$$

estimating the required minimal addition of strontium to the liquid metal using $$Sr_{eff\text{-}min}(\text{wt }\%)=a1+b1*P_{eff}(\text{wt }\%) \quad (3);$$

estimating the allowed maximal addition of strontium to the liquid metal using $$Sr_{eff\text{-}max}(\text{wt }\%)=a2+b2*P_{eff}(\text{wt }\%) \quad (4);$$

where:

$P_{eff}$ (wt %) is the combined effect of trace elements in weight percent on eutectic modification;

P (wt %) is the phosphorous weight percent in the liquid metal;

Sb (wt %) is the antimony weight percent in the liquid metal;

Bi (wt %) is the bismuth weight percent in the liquid metal;

Ca (wt %) is the calcium weight percent in the liquid metal;

$Sr_{eff\text{-}min}$ (wt %) is the required minimal addition of strontium in weight percent to the liquid metal eliminate macro shrinkage;

$Sr_{eff\text{-}max}$ (wt %) is the allowed maximal addition of strontium in weight percent to the liquid metal eliminate gas bubbles; and a1, a2, b1, b2, c1, c2, c3 are constants that depend on a given set of casting component geometry and casting process parameters; and the computer useable medium is cooperative with the information input and the information output such that the received information is operated upon by the computer-readable program code means to be presented to the information output as an estimation of the proper eutectic modification level of the liquid metal during aluminum casting;

the mold is configured to receive the liquid metal such that porosity due to at least one of macro shrinkage and gas bubble formation is reduced.

13. The article of manufacture of claim 12, wherein the liquid metal is an aluminum silicon alloy.

14. The article of manufacture of claim 13, wherein the aluminum silicon alloy comprises a hypoeutectic alloy or a near eutectic alloy.

15. The article of manufacture of claim 12, wherein the information relating to trace elements of the liquid metal comprises at least one of phosphorus, antimony, bismuth, calcium, strontium, and sodium.

16. The article of manufacture of claim 12, wherein the information relating to casting component geometry comprises at least one of wall thickness and variations, geometrical structure configuration, maximum three dimensional dimensions, and shrinkage feeding capability.

17. The article of manufacture of claim 12, wherein the information relating to casting process parameters comprises at least one of liquid metal pouring temperature, mold filling method and fill profile, chill and metal insert configuration and temperatures, and casting mold temperature.

18. The article of manufacture of claim 12, wherein the received information relating to trace elements of the liquid metal is determined by at least one of direct measurement and analytical prediction.

19. The article of manufacture of claim 18, wherein said direct measurement weight percentage measurement of the trace element in the liquid metal by at least one of inductively coupled plasma atomic emission spectrometry (ICP-AES), inductively coupled plasma optical emission spectrometry (ICP-OES), inductively coupled plasma mass spectrometry (ICP-MS), atomic absorption spectrometry (AAS), and x-ray fluorescence spectrometry (XRF).

20. The article of manufacture of claim 12, wherein the received information relating to casting component geometry and casting process parameters is determined by direct measurement.

* * * * *